United States Patent [19]

Dacey, Jr.

[11] Patent Number: 4,928,388

[45] Date of Patent: May 29, 1990

[54] SINGLE STATION HEMMING TOOLING

[75] Inventor: Ernest A. Dacey, Jr., Sterling Heights, Mich.

[73] Assignee: Utica Enterprises, Inc., Sterling Heights, Mich.

[21] Appl. No.: 317,834

[22] Filed: Mar. 1, 1989

Related U.S. Application Data

[60] Division of Ser. No. 891,292, Jul. 31, 1986, Pat. No. 4,827,595, which is a continuation-in-part of Ser. No. 805,893, Dec. 5, 1985, Pat. No. 4,706,489.

[51] Int. Cl.[5] ..... B23P 11/00

[52] U.S. Cl. ..... 29/798; 29/21.1; 29/243.52; 29/243.57

[58] Field of Search ..... 29/21.1, 33.5, 521, 29/566.1, 432.2, 511, 509, 243.58, 243.57, 243.52, 798; 72/325, 294, 312–315

[56] References Cited

U.S. PATENT DOCUMENTS

| | | | |
|---|---|---|---|
| 2,122,557 | 7/1938 | Canter | 29/521 |
| 2,569,181 | 9/1951 | Laxo | 72/312 |
| 2,726,702 | 12/1955 | Laxo | 72/315 |
| 2,964,829 | 12/1960 | Spengler et al. | 29/21.1 |
| 3,058,512 | 10/1962 | Chebuhar et al. | 72/312 |
| 3,249,023 | 5/1966 | Toby | 29/21.1 |
| 3,332,473 | 7/1967 | Frederickson et al. | 29/521 |
| 3,781,962 | 1/1974 | Norris et al. | 29/21.1 |
| 4,130,927 | 12/1978 | Bergtsson et al. | 29/798 |

FOREIGN PATENT DOCUMENTS 320476 4/1920 Fed. Rep. of Germany ..... 29/21.1

*Primary Examiner*—Daniel C. Crane

*Attorney, Agent, or Firm*—Remy J. VanOphem

[57] ABSTRACT

A single station hemming device for hemming the upstanding peripheral flange of an outer element to overlie the periphery of an inner element to thereby join the outer element to the inner element. The hemming device has a series of hemming tools positioned end-to-end around the periphery of the outer element, each hemming tool being actuated in unison by a single motor to simultaneously hem the peripheral flange of the outer part. Each hemming tool is cam operated through a system of links by a single actuator to move in a first arcuate direction generally transversely of the flange to do a first stage hemming operation of about 35°–55°; then in a second arcuate direction to lift it above the flange and then in a third arcuate direction generally parallel to the original orientation of the flange to complete the remaining approximately 55°–35° of hemming of the flange. One or more of the hemming tools can be provided with a reciprocable piercing tool to pierce a tab of the peripheral flange of the outer element and an adjacent surface of a raised pad of the inner element, after conclusion of the hemming operation, to interlock the outer element and the inner element together.

3 Claims, 7 Drawing Sheets

SINGLE STATION HEMMING TOOLING

CROSS-REFERENCE TO RELATED APPLICATION

This application is a divisional application of copending U.S. Ser. No. 891,292, filed July 31, 1986, now U.S. Pat. No. 4,827,595, which is a continuation-in-part application of U.S. Ser. No. 805,953, filed Dec. 5, 1985, now U.S. Pat. No. 4,706,489 which issued Nov. 17, 1987.

BACKGROUND OF THE INVENTION

1. Field of the Invention

This invention relates to tooling for forming a hem between a pair of overlapped metal pieces, that is, for deforming an edge of one of the metal pieces to overlie the other metal piece in a continuous or nearly continuous pattern.

2. Description of the Prior Art

Hemming is a technique that is widely used in the automotive industry for joining a sheet of metal that serves as an external body component to a formed piece of metal that serves as a reinforcing element for such external body component. For example, the trunk deck lid of most front engine automotive vehicles is of two-piece construction in which the outer edge of the outer element of the trunk deck lid is folded over against the outer edge of an inner reinforcing element by a hemming process. Devices for performing hemming operations of the type described are shown in U.S. Pat. No. 4,346,579 to Takatsu and U.S. Pat. No. 4,484,467 to Kitano, et al.

The hemming process, as described, normally also involves the application of a thermosetting organic sealing compound between the overlapped edges of the inner and outer elements, to help prevent laceration injuries to persons who may grasp the trunk deck lid during opening or closing, since the exposed edge of the rolled over portion or hem of the outer metallic element can be rather sharp.

Many front engine automotive vehicles also utilize a two-piece hood in which the outer hood element is reinforced by an inner structural element and in which the outer edge of the outer element is folded over the outer edge of the inner element by hemming, again, with the addition of an organic sealing compound before the hemming step to cover the exposed sharp edge of the outer metallic element.

Hemming processes as heretofore described utilize an outer element with the outer edge prefolded in the form of a flange to lie approximately perpendicularly to the main portion of the outer element, such prefolding being done most conveniently in the stamping operation that is customarily utilized in the forming of such outer element. The hemming of such flange requires that it be folded over from such prefolded condition approximately ninety degrees (90°), to be against the outer edge of the inner element, after the inner element, whose main portion extends generally parallel to the main portion of the outer element, has been placed inside the flange of the outer element. The folding over or hemming of the flange of the outer element in many hemming processes of the prior art is done in multiple stages, usually in two stages, in which, in a first stage, force is applied generally perpendicularly to the original orientation of the flange to cause it to bend approximately thirty-five to fifty-five degrees (35°–55°) from its original orientation, and in which, in a second stage, force is applied generally parallel to the original orientation of the flange to cause the partially bent flange to bend an additional approximately fifty-five to thirty-five degrees (55°–35°) to complete the approximately ninety degrees (90°) of folding of the flange from its prefolded condition to securely engage the outer edge of the inner element of the two-piece structure that is being hemmed Such a two-stage hemming process is done in separate sets of tooling, tooling which is rather massive, costly, and space-consuming, and a two-stage hemming process requires a transfer operation to transfer the workpieces that are being hemmed, in unison, from the first stage tooling to the second stage tooling. Such a transfer operation involves special transfer equipment, an additional cost factor, and poses additional risks of equipment malfunction which can lead to production interruptions. Multiple stage hemming operations of the aforesaid type also require, for process considerations, a certain minimum depth of flange in the outer edge flange of the outer element that exceeds the depth of the flange that would otherwise be required based on the product requirements of the component that is being hemmed, and to the extent that the flange depth required for process considerations exceeds the flange depth required for product considerations, the finished component is more costly and more heavy than it would otherwise need to be.

The advantages of performing an entire hemming operation in a single stage are recognized in U.S. Pat. No. 3,191,414 to Kollar et al., which describes a hemming tool that is actuated sequentially in horizontal and vertical directions by separate hydraulic cylinders acting through a linkage system, and in U.S. Pat. No. 3,276,409 to St. Denis. The structures of the Kollar et al. and St. Denis patents are structurally and hydraulically complex, however, especially since a typical automotive trunk or hood hemming station requires the use of several hemming tools arranged end-to-end around the perimeter of the parts that are joined to one another. Possibly because of the complexity of the hemming tooling of the aforesaid Kollar et al. and St. Denis patents, single stage hemming of large parts, such as automotive hoods and trunk deck lids, has not heretofore proven to be successful, and is not known to be in commercial practice, at least to any appreciable extent.

Parts which have been joined to one another by hemming, and particularly large parts, such as the components of an automotive hood or an automotive trunk deck lid, are subject to some movement relative to one another if they are not, after hemming, more positively joined to one another, for example, by spot welding, where the hemmed parts are spot welded to one another. In such a case, the spot welding is done in yet another set of tooling which requires additional cost for welding tooling and labor and transfer equipment and labor and otherwise complicates the overall process for joining such parts to one another.

SUMMARY OF THE INVENTION

According to the present invention there is provided a method of and tooling for hemming an outer peripheral flange of an outer metallic element of a multiple element component to overlie the outer edge of an inner element of such component, such flange originally extending generally perpendicularly with respect to the inner portion of such inner element, in which the entire hemming operation is performed in a single station, without the need for the transfer of the parts being hemmed during the hemming operation, and without the need for multiple actuating devices. The hemming tooling has a flange contacting member and, through a system of cams and levers, the flange contacting member is initially driven generally perpendicularly of the flange with respect to the original orientation of the flange of the outer element, to do a first stage hemming or prehemming of such flange, and is subsequently driven generally parallel to the original orientation of the flange to complete the hemming or folding of the flange. Because of the way that the hemming tooling of the present invention contacts the flange of the outer element of the multiple element component that is being hemmed, the flange depth can be reduced, relative to that which is required in known prior art multiple stage hemming devices, to a depth which more nearly corresponds to that required for good product characteristics in the component being hemmed. Such reduction in the required flange depth permits a reduction in the amount of metal that is required in the outer element of such component, a factor which helps to reduce the cost and weight of such component.

The movement of the hemming tooling of the present invention, in the case of hemming generally horizontally extending metallic elements, the outer element having a flange to be folded over by the hemming tool from a generally vertically extending original position to a generally horizontal final position, involves a sequence of first and second arcuate motions which, respectively, approximate horizontal and vertical motions. The first of such motions is generally along the arc of a first ellipse, with a vertical minor axis, at least a point along such arc lying on or near the minor axis of such ellipse. The second of such motions is generally along the arc of a second ellipse with a horizontal major axis, at least a point along such second arc lying on or near the major axis of the second ellipse. The center of the second ellipse is horizontally offset with respect to the center of the first ellipse. The mechanism for driving the hemming tooling through a path with two elliptically arcuate portions includes a cam which moves the center of movement of the hemming tooling from the center of the first ellipse to the center of the second ellipse at a predetermined point in the movement of the hemming tooling corresponding to the completion of the first elliptically arcuate movement.

The flange contacting tool of the hemming tooling of the present invention can, if desired, be provided with an internal, reciprocable piercing tool to more positively join the outer member to the inner member by piercing a portion of the hemmed outer member and an adjacent portion of the inner member along superimposed U-shaped, V-shaped, or C-shaped lines that define tabs in each such outer member and inner member to force the tab portion of the outer member into the recess in the inner member that is formed by inwardly folding the tab therein. In this manner, the outer member and the inner member can be frictionally interlocked in a way that eliminates the need for a post-hemming spot welding operation, together with the equipment and labor expense that would otherwise be involved in such post-hemming welding operation.

Accordingly, it is an object of the present invention to provide an improved method of and apparatus for assembling an inner element to an outer element by hemming.

More particularly, it is an object of the present invention to provide a method of and apparatus for assembling an inner element to an outer element by hemming in which the hemming is accomplished in a single stage, without the need for the transfer of the inner and outer elements from the location of a prehemming stage to another location where the final hemming stage is performed.

It is also an object of the present invention to provide a method of and apparatus for assembling an inner element to an outer element by hemming in which compound motions are imparted to the hemming tooling by a single actuation device through a multiple element mechanism.

It is also an object of the present invention to provide an improved component that is made up of an inner element and an outer element, the inner element and the outer element being joined together by rolling over or hemming a peripheral flange of the outer element to engage the periphery of the inner element.

It is also an object of the present invention to provide a method of an apparatus for assembling an inner element to an outer element in which the inner element and the outer element are frictionally interlocked by piercing adjacent portions thereof to eliminate the need for a post-hemming spot welding operation to ensure that the inner element and the outer element have adequate resistance to relative movement therebetween.

For a further understanding of the present invention and the objects thereof, attention is directed to the drawings and the following description thereof, to the detailed description of the preferred embodiment, and to the appended claims.

DETAILED DESCRIPTION OF THE PREFERRED EMBODIMENT

Figure 1:
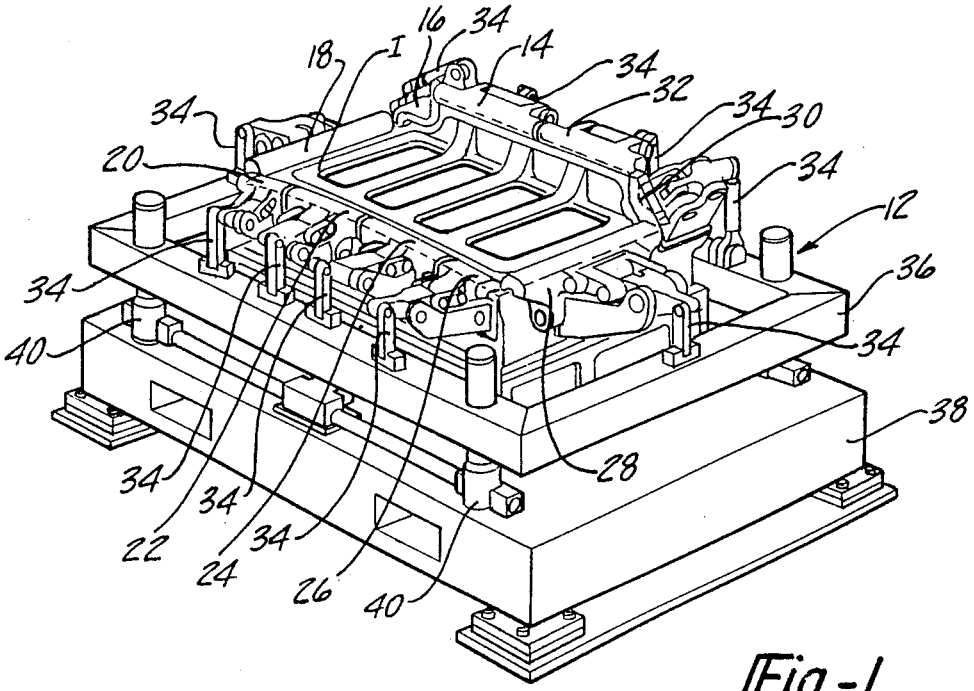
FIG. 1 is a perspective view of a hemming station that utilizes an end-to-end series of hemming tools according to the preferred embodiment of the present invention.
Figure 2:
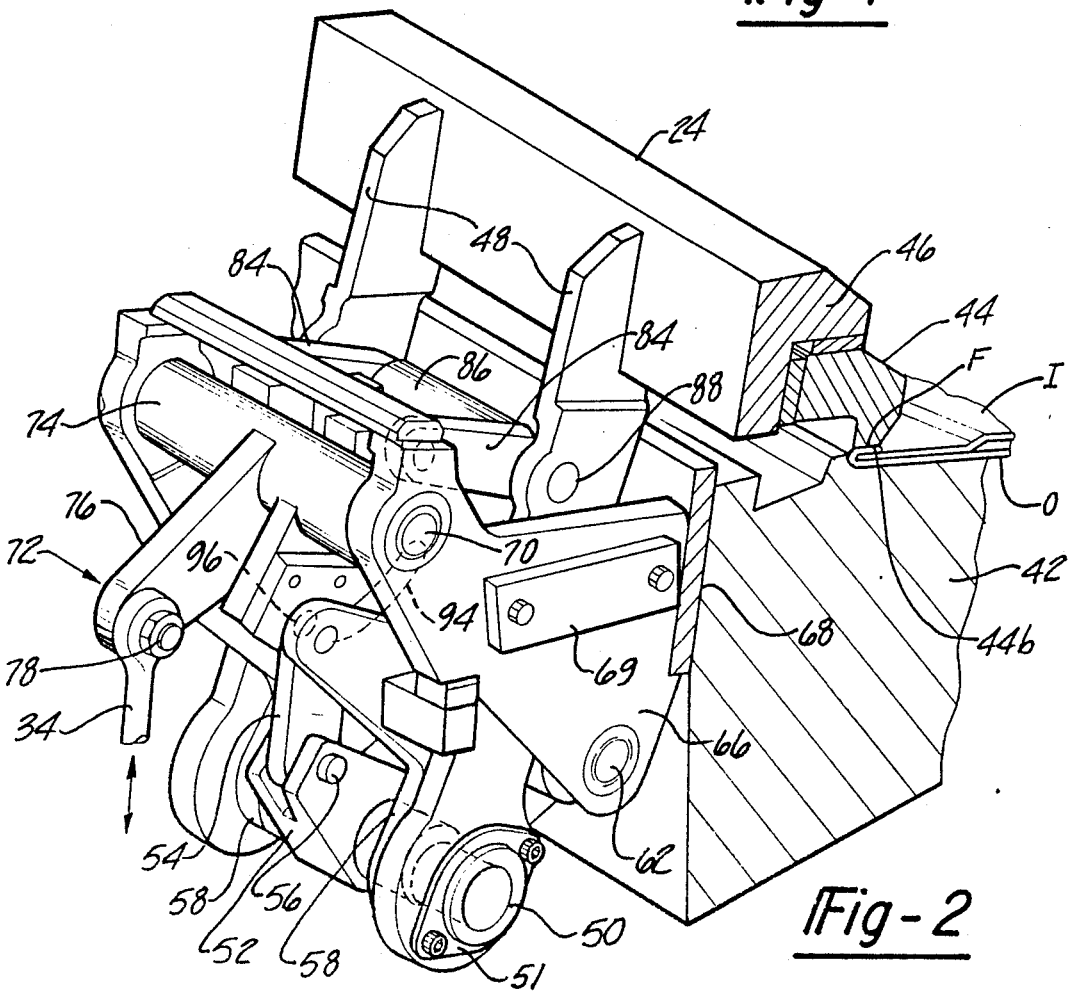
FIG. 2 is a fragmentary perspective view at an enlarged scale relative to that of FIG. 1, illustrating one of the hemming tools of the hemming station depicted in FIG. 1.

A hemming device according to the present invention is indicated generally by reference numeral 12 in FIG. 1. The hemming device 12 includes a series of individual hemming tools 14, 16, 18, 20, 22, 24, 26, 28, 30, and 32 arranged end-to-end in an annular pattern which, in the illustrated embodiment, is a generally rectangular pattern. The hemming device is used to perform a process that is generally described as a hemming process to join a pair of sheet metal parts, shown as an outer part O and an inner part I, to one another to form a two-piece component, such as the trunk deck lid or the hood of a front engine automobile. The outer part O is provided with a peripheral flange F that extends generally perpendicularly from the outer part 0, past the outer periphery of the inner part I and, in the hemming process, the flange F of the outer part O is folded over, after the application of a suitable organic sealing compound to the inside of the flange F or the periphery of the inner part I, to lie in tight engagement with the outer periphery of the inner part 1. Typically, the depth of the flange F should be approximately 5 mm to provide suitable product characteristics in a finished automotive trunk deck lid or hood. In the illustrated embodiment, the hemming of the outer part O and the inner part I is being done with the outer part O and the inner part I oriented in a generally horizontal direction during hemming. However, hemming of parts is also done with the parts being hemmed oriented in a generally vertical direction, and the hemming device of the present invention is readily adapted to such a vertical hemming operation.

The hemming tools 14, 16, 18, 20, 22, 24, 26, 28, 30, and 32 are arranged with a slight clearance between adjacent tools for mechanical clearance between the tools during the motions of the tools, as hereinafter described, but otherwise in a manner which provides nearly continuous contact between the hemming tools and the flange F of the outer part O during hemming, to prevent the forming of wrinkles in the flange F. The various hemming tools are also configured so that, together, they follow the contour of the outer part O which will, of course, be somewhat contoured or irregular to provide the finished two-piece component with an aesthetically pleasing appearance.

Each of the hemming tools 14, 16, 18, 20, 22, 24, 26, 28, 30, and 32 is actuated for movement by an individual actuation rod 34, which is reciprocable in a generally vertical direction, and the reciprocation of the actuation rods 34 of the various hemming tools occurs simultaneously by attaching an end of each actuation rod 34 to a vertically reciprocable annular platen 36. The annular platen 36 is a part of the hemming device 12, and is mounted above a fixed base element 38 of the hemming device 12 and is reciprocable with respect to the fixed base element 38 by a number of electric jack screws 40, two of which are shown in FIG. 1. The electric jack screws are driven in unison by a single motor, not shown, in a conventional manner. Of course, the annular platen 36 could also be hydraulically reciprocated with respect to the fixed base element 38 by means of an hydraulic cylinder with closed loop, flow-coordinated characteristics, as is known in the art.

As is shown in FIGS. 2 through 9, which illustrate the details of construction of the hemming tool 24, each of the hemming tools 14, 16, 18, 20, 22, 24, 26, 28, 30, and 32 is provided with a tool element 44, and the tool elements 44 of the various hemming tools contact the flange F of the outer part O in a nearly continuous pattern, following the in and out and up and down variations in the contour of the outer part O, as heretofore described. While ten hemming tools have been provided to perform the hemming operation in the illustrated embodiment, the actual number of tools needed in any given hemming operation can vary, based, mainly, on the size and complexity of the shape of the parts being hemmed and, therefore, any given hemming device can use ten, more than ten, or less than ten of such hemming tools.

Of interest with respect to the hemming operation that is being performed by the hemming device 12 that is shown in FIG. 1, the portion of the edge of the inner part I that is adjacent the hemming tools 32 and 14 is substantially higher in elevation than the portion that is adjacent the hemming tools 22 and 24, with the hemming tools 30 and 16, therefore, being inclined to properly act on the corner portions of the inner part I that experience the most abrupt changes in elevation.

The hemming of the flange F of the inner part I is performed by the tool element 44 which has a chamfered first stage flange-contacting surface **44*a* and a generally horizontal second stage flange-contacting surface 44*b*. The tool element 44 is adjustably affixed to a tool holding block 46 in a conventional manner, for example, by threaded fasteners. The tool holding block 46, in turn, is affixed at spaced apart locations thereof to the upper ends of a first pair of links 48** which generally extend in a vertical direction.

The lower end of each of the first pair of links 48 is rotatably affixed to the opposed end of a floating, oscillatable shaft 50. The oscillatable shaft 50 is caused to oscillate in a manner which will be hereinafter described, and the oscillation of the oscillatable shaft 50 will impart generally vertical reciprocatory motion to the tool element 44 by virtue of the construction features hereinafter described.

Oscillating movement is imparted to the oscillatable shaft 50 by a central link 52 which is keyed or otherwise non-rotatably affixed to a central portion **50*a* of the oscillatable shaft 50, between the first pair of links 48. The central portion 50*a* of the oscillatable shaft 50 has an axis which is offset from the axis of the end portions of the oscillatable shaft 50 to which the first pair of links 48 are attached by means of apertures 49 in the lower ends of the first pair of links 48. Thus, the end portions of the oscillatable shaft 50 are eccentric with respect to the central portion 50*a* of the oscillatable shaft 50, and the transmission of oscillating motion to the central portion 50*a* of the oscillatable shaft 50 by the oscillation of the central link 52 will cause the first pair of links 48 to be reciprocated in generally vertical paths by virtue of the "throw" of the end portions of the oscillatable shaft 50 relative to the central portion 50***a* thereof.

The oscillation of the central link 52 is caused by a drag link 54 which is pivotally connected to the central link 52 by means of a pin 56, whose axis is spaced apart from the axis of the central portion 50*a* of the oscillatable shaft 50. Preferably, the portion of the central link 52 to which the drag link 54 is pivotally connected is in the form of a clevis, with the drag link 54 being positioned between the legs of such clevis portion, to avoid the imposition of unbalanced torque loads acting on the pin 56. As is shown most clearly in FIG. 8, the central link 52 is formed in two pieces, 52*a* and 52*b*, which are joined together around the central portion 50*a* of the oscillatable shaft 50, for ease in assembling the central link 52 to the oscillatable shaft 50. Likewise, for ease of assembly, the apertures 49 of the first pair of links 48 are oversize so that the central portion 50*a* can be inserted therethrough and the clearance spaces between the end portions of the oscillatable shaft 50 and the apertures 49 of the first pair of links 48 are fitted by end caps 51 which are bolted to the first pair of links 48.

Figure 8:
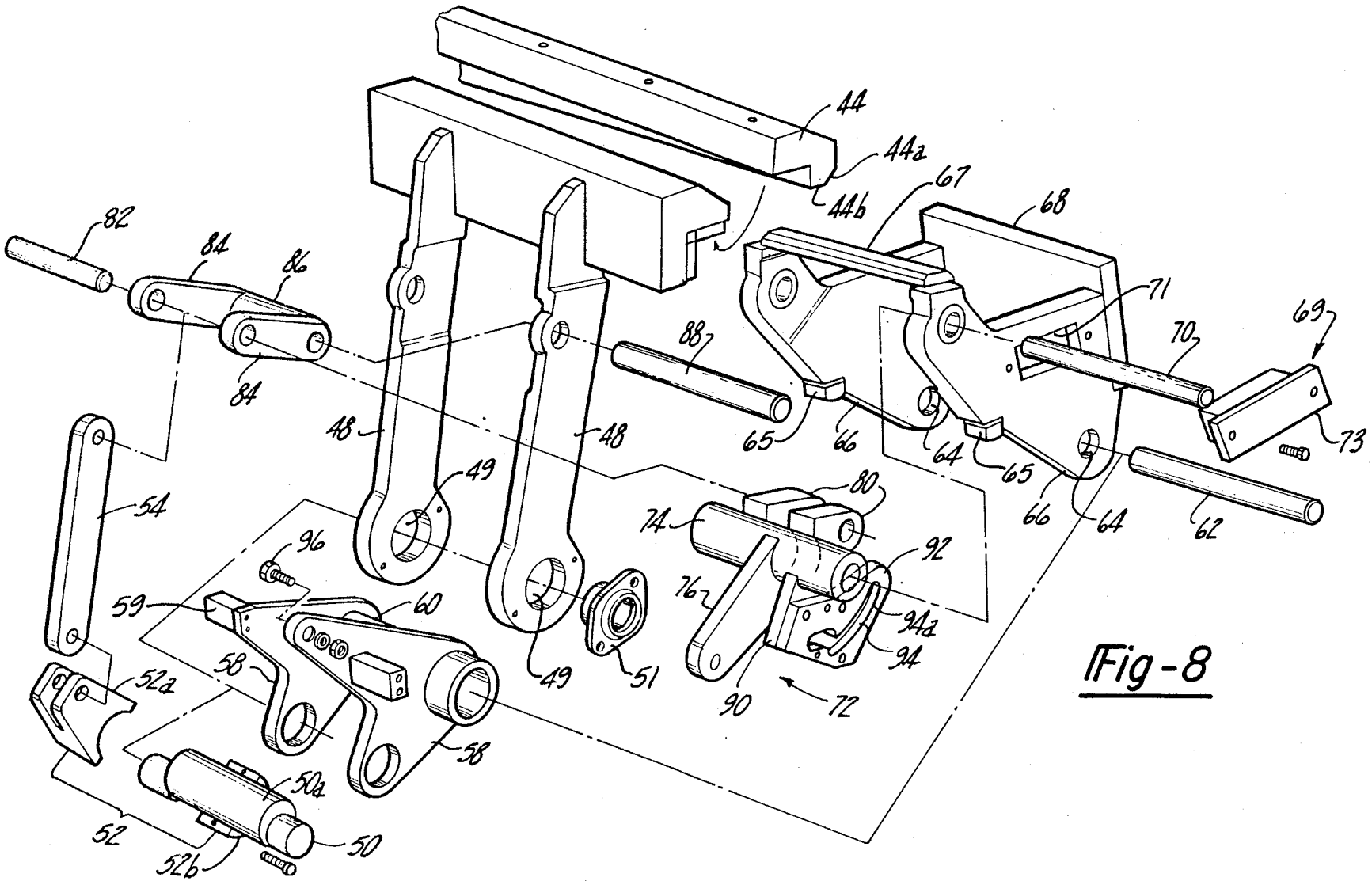
FIG. 8 is an exploded view depicting the hemming tool and certain portions of the mechanism depicted in FIGS. 3 through 7.

The mechanism for imparting motion to the tool element 44 also includes a second pair of links 58, each of which is generally triangularly shaped, as is shown in FIG. 8. Each of the second pair of links 58 is non-rotatably attached to a tubular element 60. The tubular element 60, in turn, is oscillatable about an axis which is maintained in a fixed position relative to a fixed bed 42 of the hemming device 12, such axis extending centrally through a central rod 62 that extends through aligned holes 64 in a spaced apart pair of flanges 66 that are affixed to a plate 68, the flanges 66 being connected to a transverse bar 67 to impart rigidity to each of the flanges 66. The plate 68, in turn, is affixed to the fixed bed 42. Each of the second pair of links 58 is also rotatably affixed to the central portions 50*a* of the oscillatable shaft 50 at a location that extends parallel to, and is spaced apart from, the central axis of the central rod 62. Thus, the oscillation of the oscillatable shaft 50, as heretofore described, will impart oscillation to each of the first pair of links 48 about the axis extending through the center of the central portion 50*a* of the oscillatable shaft 50 without imparting such oscillation to the second pair of links 58.

Figure 3:
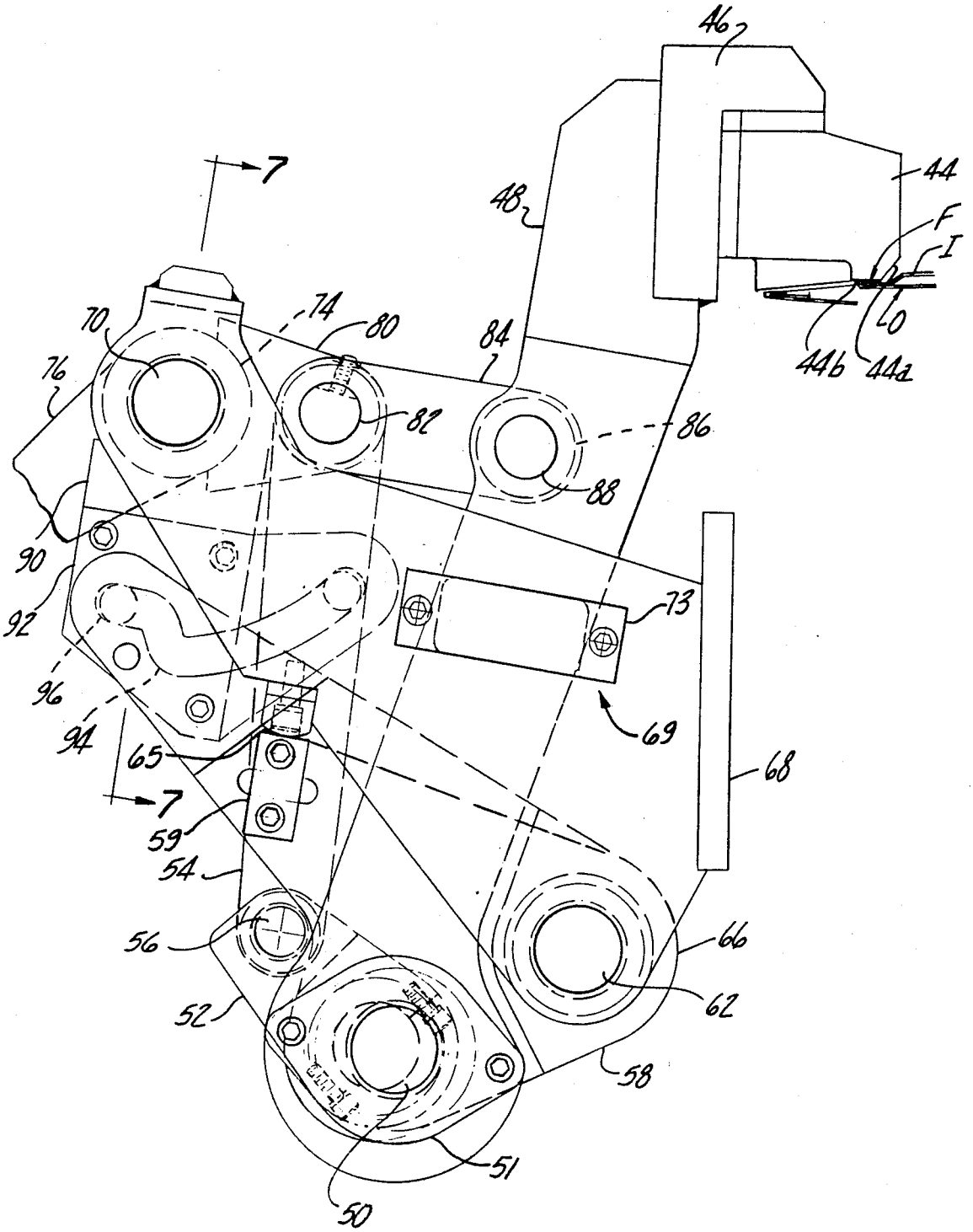
FIG. 3 is a fragmentary front elevational view, at an enlarged scale relative to that of FIG. 2, illustrating the hemming tool of FIG. 2 together with a mechanism for transmitting motion to such hemming tool.
Figure 4:
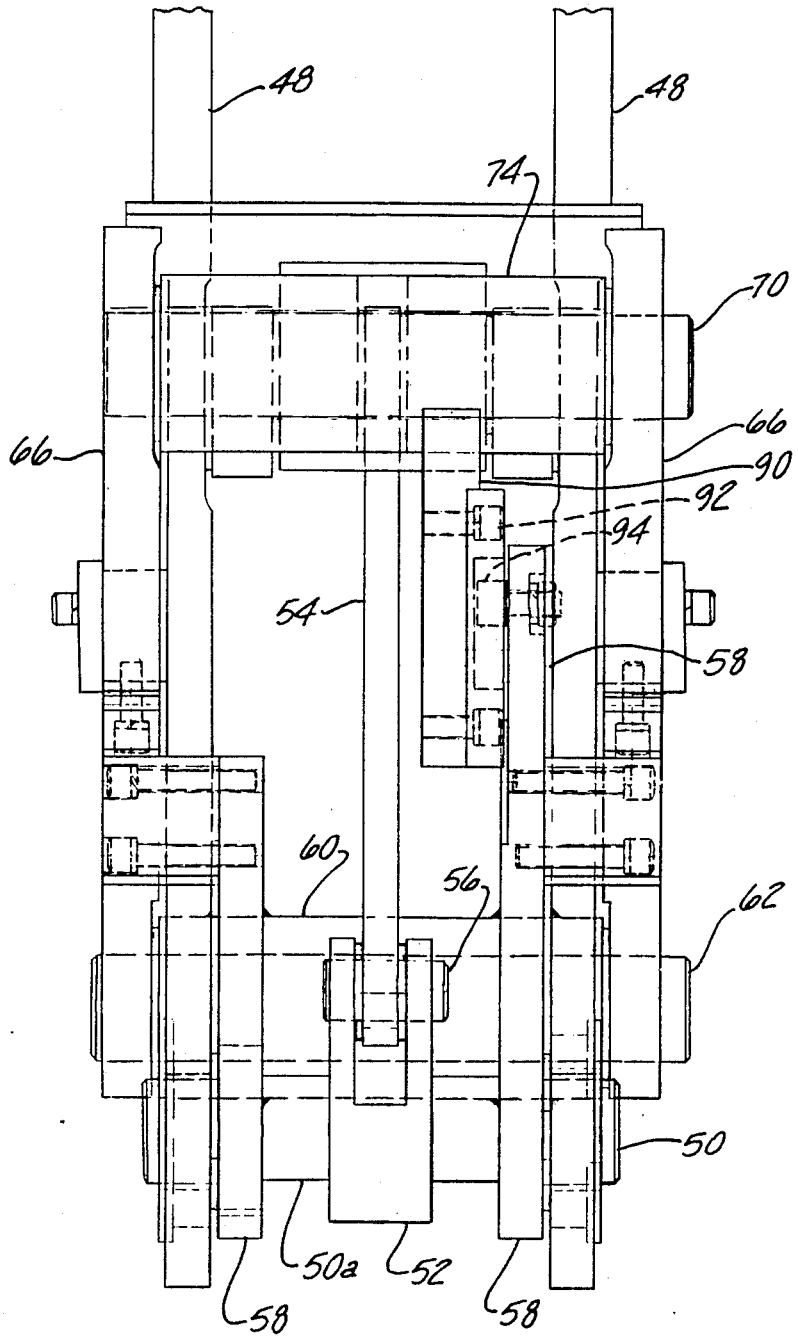
FIG. 4 is a fragmentary rear elevational view of the hemming tool and mechanism depicted in FIG. 3.
Figure 5:
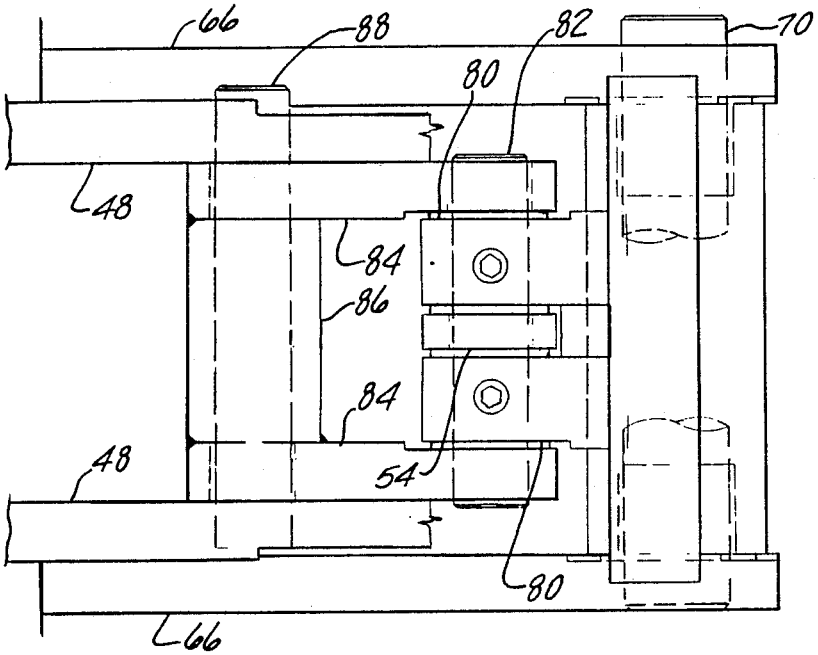
FIG. 5 is a top plan view of the hemming tool and mechanism depicted in FIGS. 3 and 4.

The spaced apart pair of flanges 66 have a pivot rod 70 extending therethrough, the axis of the pivot rod 70 being spaced apart from and parallel to the axis of the central rod 62, the pivot rod 70 being located above and to the left of the shaft of the location of the central rod 62 in the orientation depicted in FIG. 3. The actuation rod 34 imparts oscillating motion to the pivot rod through a T-shaped element, which is generally indicated by reference numeral 72. The T-shaped element 72 has a tubular head portion 74 which is keyed, pinned or otherwise non-rotatably secured around the pivot rod 72, and a shank portion 76, one end of which is welded or otherwise affixed to the tubular head portion 74. The other end of the shank portion 76 is pivotally attached to the actuation rod 34 by means of a pin 78; thus, the generally vertical reciprocation of the actuation rod 34 leads to oscillation of the generally T-shaped element 72 about the central axis of the pivot rod 70.

The generally T-shaped element 72 also includes a pair of spaced apart flanges 80 which are affixed to the tubular head portion 74 and which form an upper clevis. The upper clevis formed by the pair of spaced apart flanges is pinned, keyed, or otherwise non-rotatably affixed to an upper pivot rod 82, and one end of each of a spaced apart pair of horizontal connecting links 84 is pivotally mounted on the upper pivot rod 82. For ease of assembly, each of the connecting links 84 are joined together at their other ends by a tubular member 86. The tubular member 86 is pivotally attached to the first pair of links 48 by means of a pivot pin 88. Thus, the connection of the first pair of links 48 to the pivot rod 70, by means of the connection of the pivot rod 70 to the upper pivot rod 82 by the pair of spaced apart flanges 80, and then by the connection of the upper pivot rod 82 to the pivot pin 88 by the pair of connecting links 84 and the tubular member 86, results in generally horizontal oscillation approximating linear reciprocation of the central axis of the pivot pin 88 and, in turn, the tool element 44, when the pivot rod 70 is oscillated by the generally vertical reciprocation of the actuation rod 34, as heretofore described.

Figure 7:
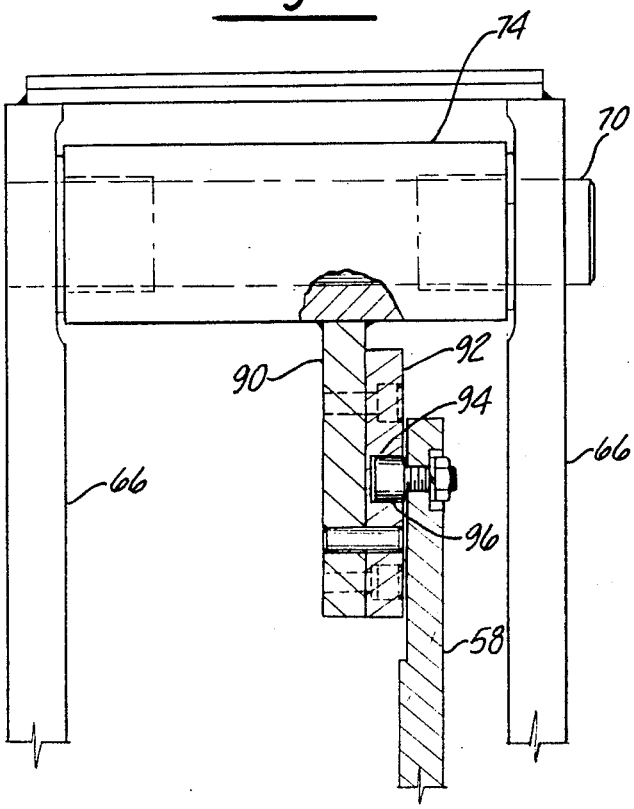
FIG. 7 is a sectional view taken along line 7—7 of FIG. 3.
Figure 6:
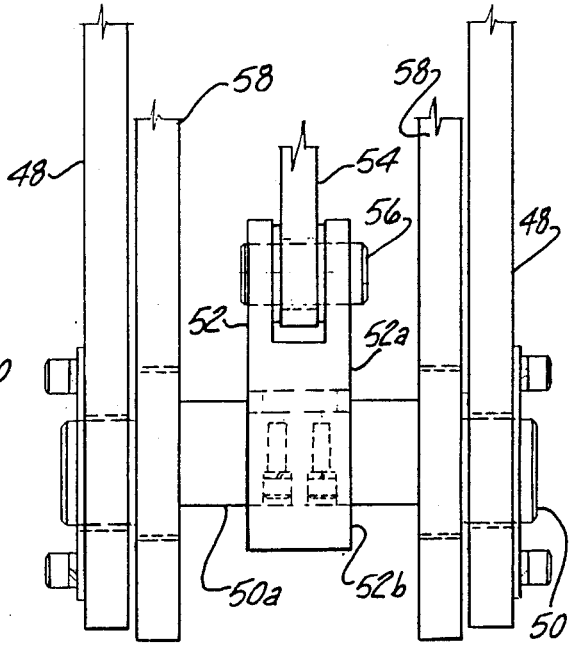
FIG. 6 is a fragmentary rear elevational view depicting another portion of the mechanism depicted in FIGS. 3 through 5.

As is shown most clearly in FIGS. 7 and 8, the tubular head portion 74 of the T-shaped element also has a cam plate supporting plate 90 affixed thereto and depending therefrom, and the cam plate supporting plate 90 has a cam plate 92 removably attached thereto. The cam plate 92 has a cam groove 94 cut in the side thereof which is away from the cam plate supporting plate 90. One of the second pair of links 58 carries a cam roller 96 which rides in the cam groove 94 of the cam plate 92. Thus, as oscillating motion about the pivot rod 70 is imparted to the T-shaped element 72 by the generally vertical reciprocation of the actuation rod 34, as heretofore described, reciprocating motion will be imparted to the tubular element 60 by the one of the second pair of links 58 that carries the cam roller 96, as the cam roller rises and falls in a predetermined pattern by the configuration of the cam groove 94 in which it rides.

Figure 9:
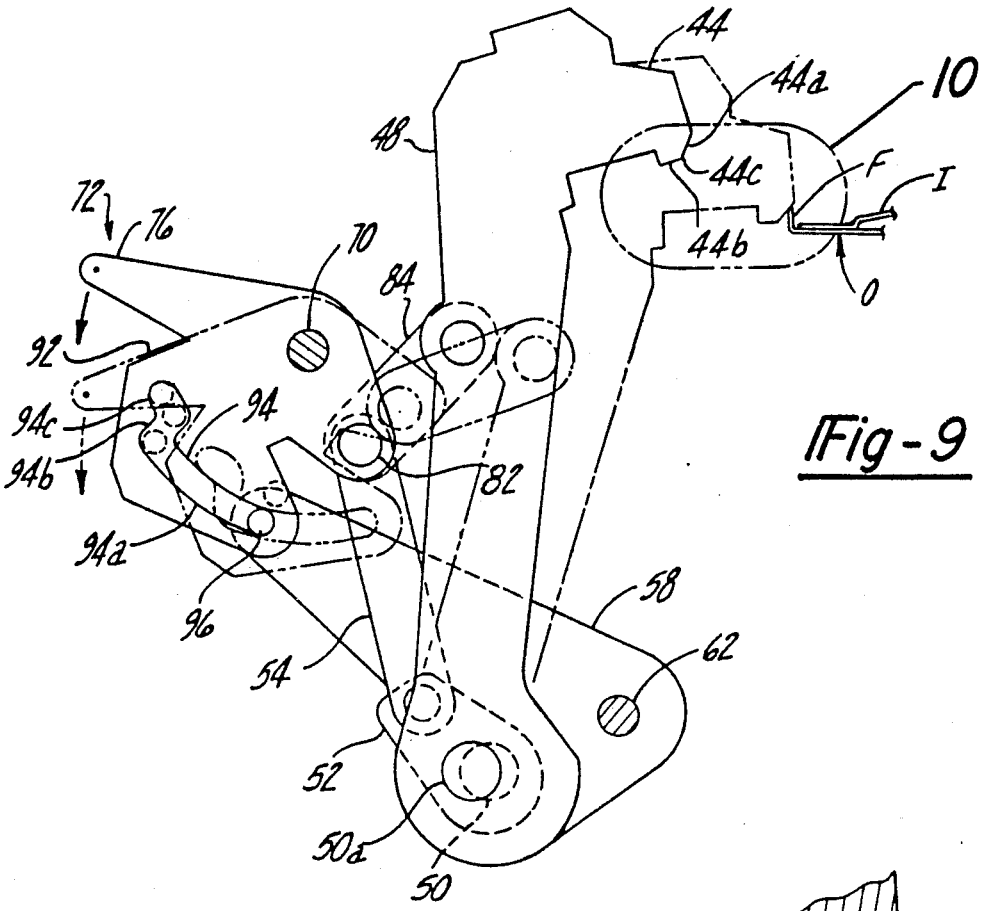
FIG. 9 is a schematic front elevational view of a hemming tool with an alternative embodiment of a mechanism for transmitting motion to such hemming tool.
Figure 10:
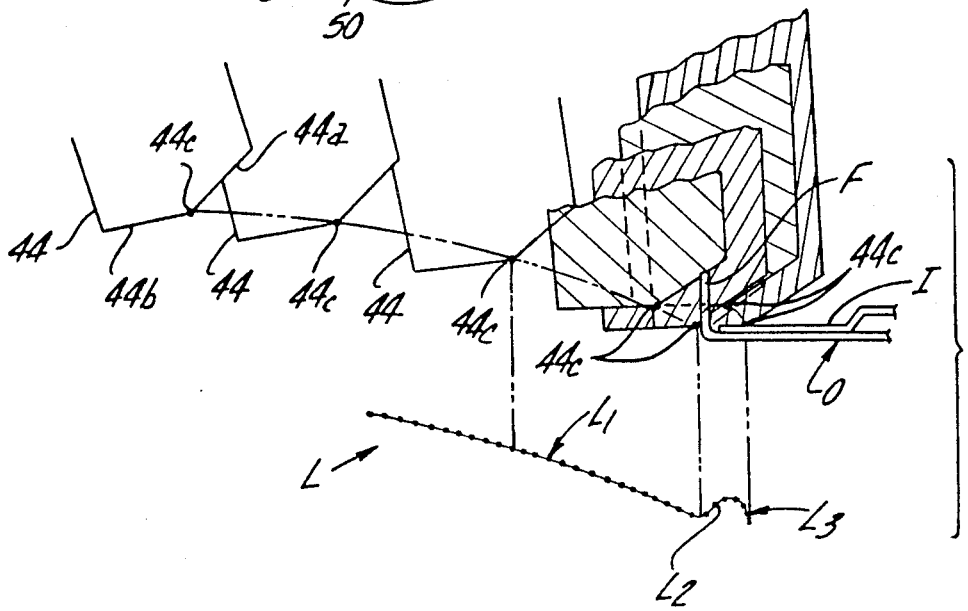
FIG. 10 is a fragmentary schematic view depicting the path of travel of the hemming tool of FIG. 9.

The operation of the hemming tooling of the present invention may be better understood with reference to FIGS. 9 and 10. In FIG. 9, the position of the illustrated link of the first pair of links 48 in its fully retracted position, before it begins its hemming motion, is shown in solid line, and its position at the start of the hemming process, when it first makes contact with the flange F of the outer part O which is being joined to the inner part I is shown in broken line. Similarly, the position of the shank portion 76 of the T-shaped element 72, the position of one of the pair of connecting links 84, and the position of the cam roller 96 are shown in solid line in the positions that they occupy when the illustrated link 48 is in the fully retracted position, and in broken line in the positions that they occupy when the illustrated link 48 is in its broken line position. Thus, when the actuation rod 34 is retracted, the T-shaped element 72 will be moved in a counterclockwise direction around its center of oscillation which is the central axis of the pivot rod 70. This will raise the central axis of the upper pivot rod 82, which will cause the illustrated link 48 to reorient itself from the angular orientation depicted in solid line to the more nearly horizontal orientation depicted in broken line, moving the tool element 44 into a position where the chamfered first stage flange contacting surface 44*a* thereof first makes contact with the top of the flange F of the outer part O.

The cam groove 94 in the cam plate has a first arcuate track portion 94*a*, and this first arcuate track portion 94*a* is preferably in the arc of a circle with a radius centered on the central axis of the pivot rod 70. In the motion of the tool element 44 from the solid line position illustrated in FIG. 9 to the broken line position, the counterclockwise rotation of the T-shaped element 72 will cause the cam plate 92 to rotate about the central axis relative to the central axis of the pivot rod 70 to cause the first arcuate track portion 94a of the cam groove to move relative to the cam roller 96 from a point at or near the end of the first arcuate track portion 94a on the right side thereof, in the illustrated version, to a point near the end of the first arcuate track portion 94a on the left side thereof. No vertical motion will be imparted to the cam roller 96 by this portion of the movement of the cam plate 92, however, because of the fact that the first arcuate track portion 94a of the cam groove 94 is in the arc of a circle with a center on the center of rotation of the cam plate 92, as heretofore explained.

The path of travel of the hemming tool element 44 from the solid line position illustrated in FIG. 9 is further illustrated in FIG. 10 where the path of travel of a point 44c at the juncture of the chamfered first stage flange contacting surface 44a and the horizontal second stage flange contacting surface 44b of the hemming tool element is identified by the line L. The path of travel of the point 44c along the path of travel L follows a first portion L1 which is generally horizontal and nearly lineal, actually in the configuration of an arc of an ellipse with a horizontal major axis, such arc extending from a point at or near the top of the vertical minor axis and away therefrom. The first portion L1 of the path of travel L takes the point 44c from the solid line position in FIG. 9 to and beyond the broken line position in FIG. 9, to fold over the flange F of the outer part O from an upright or vertical position to a position approximately midway between such vertical position and the final desired horizontal position.

The position of the point 44c at the right extremity of the first portion L1 of the path of travel L represents the point at which the cam roller 96 has come to the left-hand end of the first arcuate track portion 94a of the cam groove 94, by virtue of the rotation of the cam plate 92 relative to the cam roller 96, as heretofore described. The left-hand end of the first arcuate track portion 94a of the cam groove 94 leads into the bottom end of a second, generally radially extending portion 94b of the cam groove 94, and further rotation of the cam plate 92 will cause the cam roller 96 to rise vertically as the second generally radially extending portion 94b of the cam groove 94 moves past the cam roller 96 This vertical rising of the cam roller 96 will cause the second pair of links 58 to rotate in a clockwise direction around the central axis of the central rod 62, thereby causing the central axis of the oscillatable shaft 50 to move clockwise in a circular arc around the central axis of the central rod 62. This clockwise movement of the central axis of the oscillatable shaft 50 will lift the first pair of links 48 so that the point 44c of the hemming tool element 44 will move up and over the top of the now partially folded in flange F of the outer part O along a second portion L2 of the path of travel L.

After the cam roller 96 reaches the uppermost end of the second generally radially extending portion 94b of the cam groove, further rotation of the cam plate 92 will cause the cam roller 96 to pass into a third portion 94c of the cam groove 94. This will cause the pair of connecting links 84 to be further rotated in a clockwise direction, imparting some additional horizontal motion to the point 44c of the tool element and, at the same time, imparting upward motion to the drag link 54 by virtue of its pivoted attachment to the upper pivot rod 82 to which an end of each of the pair of connecting links 84 is attached, as described. The upward movement of the drag link 54, by virtue of the pivoted attachment of the drag link 54 to the central link 52, will cause the central link 52 to impart clockwise arcuate movement to the oscillatable shaft 50. This clockwise arcuate movement of the oscillatable shaft 50 will, through the mounting of the first pair of links 48 to the eccentric end portions of the oscillatable shaft 50, cause such end portions to draw the first pair of links 48 downwardly with a very high mechanical advantage since the "throw" of the eccentric end portions of the oscillatable shaft 50, for a typical hemming flange depth, need only be a fraction of an inch, e.g., $\frac{3}{8}$ inch. In any case, the resultant of the path of travel of the point 44c of the tool element 44 during this portion of its path of travel L, which is designated as the third portion L3, will be generally vertically downwardly as shown in FIG. 10, and this will apply a very high collapsing load to the portion of the flange of the outer part O that is below the tool element during its travel along the third portion L3 of the path of travel L of its point 44c. Upon the completion of the hemming operation, as described, the first pair of links 48 is retracted through a reversal of the motion, as heretofore described, by the lifting of the annular platen 36 and the resulting lifting of the actuation rods 34, to permit the removal of the now-hemmed inner part I and the outer part O from the hemming device 12 and the insertion of a new inner part I and a new outer part O for a repeat of the hemming cycle.

To help avoid the imposition of excessive loads on the cam roller 96 during the third portion L3 of the path of travel L of the point 44c of the tool element 44, each of the second pair of links 58 is provided with an outwardly projecting stop member 59. Each stop member 59 makes contact with a fixed stop 65 on the underside of each of the spaced apart pair of flanges 66. Upon the clockwise portion of the oscillation of the second pair of links 59 about the central axis of the central rod 62, as heretofore described, each stop member 59 of each of the second pair of links 58 will make contact with the fixed stop 65. This contact will occur before the beginning of the third portion L3 of the path of travel L, the portion of the path of travel L that results in the imposition of the greatest load on the first pair of links 48 as a result of the high mechanical advantage derived from the throw of the eccentric end portions of the oscillatable shaft 50, which loads are needed for the final collapsing of the flange F of the outer part O.

Because of the magnitude of the loads on the first pair of links 48 during the final collapsing of the flange F of the outer part O and the inherent length of such first pair of links 48, they are somewhat subject to buckling during such final collapsing stage. This buckling can be avoided by the use of side support in the form of bronze or similar wear bars 69 which extend through apertures 71 in each of the spaced apart pair of flanges 66 to make sliding contact with the adjacent link of the first pair of links 4B. Each of the wear bars 69 has an enlarged head portion 73 by which it is bolted to the adjacent flange of the spaced apart pair of flanges 66.

Figure 11:
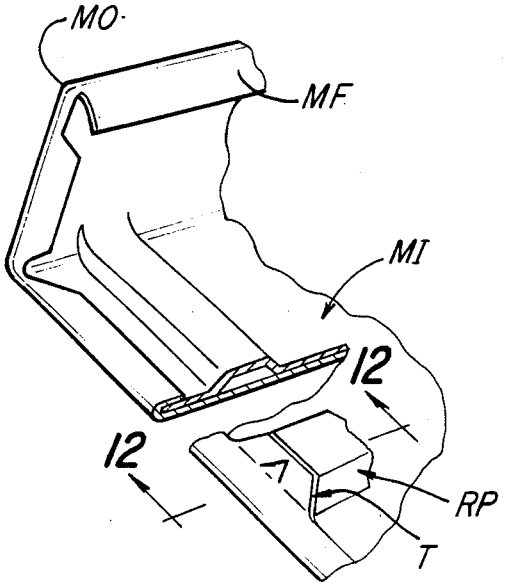
FIG. 11 is a fragmentary perspective view of a modified inner element and a modified outer element that can be frictionally interlocked with one another by a piercing operation as part of the hemming operation to thereby eliminate the need for a post-hemming spot welding operation to ensure that the inner element and the outer element have adequate resistance to relative movement therebetween.
Figure 12:
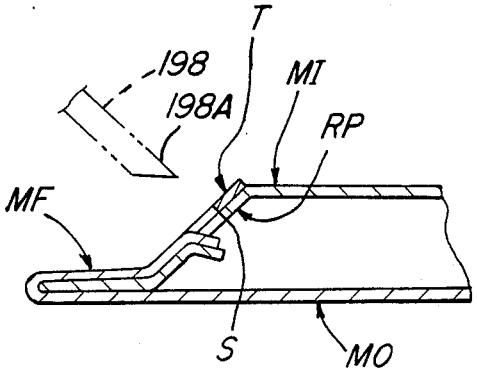
FIG. 12 is a sectional view taken on line 12—12 of FIG. 11.
Figure 13:
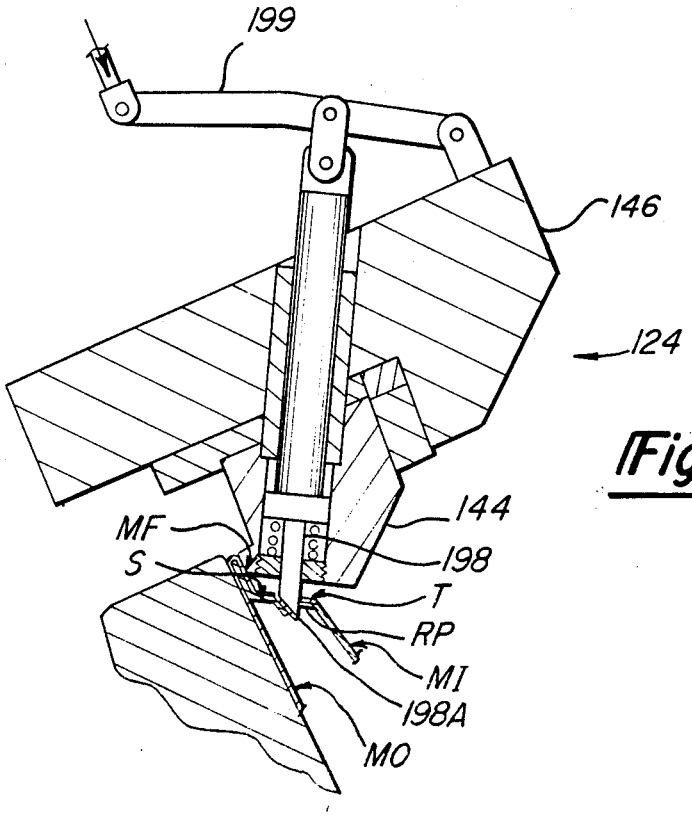
FIG. 13 is a sectional view of an alternative embodiment of a hemming tool having a reciprocable piercing tool therein for performing the piercing operation with respect to the modified inner element and the modified outer element of FIGS. 11 and 12.

FIGS. 11 through 13 illustrate a modified hemming tool, indicated generally by reference numeral 124, which, except as is otherwise described herein, is the same in construction and operation as the hemming tool 24 of the embodiment of FIGS. 1 through 10. The hemming tool 124 is used to join a modified outer part MO to a modified inner part MI by a process that includes a hemming operation. The modified outer part MO has a modified flange MF which, like the flange F of the outer part O of the embodiment of FIGS. 1 through 10, is folded over in the hemming operation to lie in tight engagement with the outer periphery of the adjacent inner part, in this case, the modified inner part MI. The modified outer part MO has at least one tab T, and, preferably, a plurality of such tabs around the periphery thereof, extending outwardly from the free edge of the modified flange MF and at an angle with respect to the modified flange MF so that it will extend upwardly from the general plane of the modified outer part MO at the conclusion of the hemming operation, as is shown in FIGS. 12 and 13. The modified inner part MI, in turn, has a raised pad RP adjacent each tab T of the modified outer part MO, and each raised pad has a surface S which will lie adjacent to the tab T of the modified outer part MO, in surface to surface or near surface to surface contact therewith, at the conclusion of the hemming operation.

To more positively anchor the modified outer part to the modified inner part than can be done simply by hemming, and as a substitute for a separate spot welding operation as is known in the prior art to accomplish such more positive anchoring, there is provided a reciprocable piercing tool 198 which reciprocates within the tool element 144 of the modified hemming tool 124 and the tool holding block 146 to which the tool element 144 is affixed under the influence of a drive mechanism 199 which may be actuated by means, such as an hydraulic cylinder or motor, not shown, or even by hand. The reciprocable piercing tool 198 has a sharpened tip **198*a*, preferably in the form of a double-ended configuration such as the configuration of a U or a V or even a C, and is positioned such that, at the conclusion of the hemming operation and upon actuation of the drive mechanism to advance the reciprocable piercing tool outwardly from the tool element the sharpened tip 198*a* will pierce the tab T of the modified outer part MO and the surface S of the raised pad RP of the modified inner part MI. This action of the reciprocable piercing tool 198 will open up a double-ended cut in the surface S of the raised pad by deflecting a small tab portion thereof within such double-ended cut away from the plane of the surface S and, similarly, will deflect a small tab portion of the tab T within a corresponding double-ended cut away from the plane of the tab T and, thereby, into the opening in the surface S within the double-ended cut therein. This action is illustrated in FIG. 12. In this manner, the modified outer part MO and the modified inner part MI are now at least partially positively frictionally positioned with respect to one another, and the requirement for a spot welding operation to accomplish such positive positioning of the parts is eliminated. If necessary to more positively frictionally interlock the modified outer part MO to the modified inner part, one or more of the remaining hemming tools 14, 16, 18, 20, 22, 26, 28, 30 and/or 32 can be modified to perform a piercing operation with respect to another tab extending from the modified flange MF of the modified outer part MO and with respect to another raised pad of the modified inner part, similar to the modification of the hemming tool 24 that resulted in the modified hemming tool 124**, as described above.

Although the best mode contemplated by the inventor for carrying out the present invention as of the filing date hereof has been shown as described herein, it will be apparent to those skilled in the art that suitable modifications, variations, and equivalents may be made without departing from the scope of the invention. This invention is to be limited solely by the terms of the claims appended hereto.

What is claimed is:

1. Apparatus for hemming an upstanding flange at the periphery of an outer piece to overlie the periphery of an inner piece which overlies said outer piece to thereby join said outer piece and for piercing a tab extending from said flange and an adjacent surface of a portion of said inner piece to thereby at least partially interlock said outer piece and said inner piece, said apparatus comprising:

a tool element having a first contact surface and a second contact surface contiguous to said first contact surface, said first contact surface engaging said upstanding flange at the periphery of said outer piece to partially fold said upstanding flange over said periphery of said inner piece, said second contact surface engaging said partially folded upstanding flange to completely fold over said upstanding flange of said outer piece over said periphery of said inner piece such as to complete the hemming of said flange;

a piercing tool integrally mounted with said tool element for movement therewith, said piercing tool being reciprocable within said tool element;

means for moving said tool element in a first arcuate motion towards said upstanding flange to engage said upstanding flange of said outer piece and to partially fold said upstanding flange of said outer piece over the periphery of said inner piece, said means for moving said tool element further comprising means for completely folding over and joining said outer piece to said inner piece such that said folded over flange of said outer piece is in intimate contact with said inner piece; and means for reciprocating said piercing tool within said tool element, said reciprocating means moving said piercing tool to pierce said tab in said folded over flange of said outer piece and said periphery of said inner piece to interlock said outer piece and said inner piece.

2. An apparatus according to claim 1 wherein said piercing tool has a double-ended sharpened tip.

3. An apparatus according to claim 2 wherein said double-ended sharpened tip is generally the configuration that is selected from the group consisting of the configuration of a U, the configuration of a V, and the configuration of a C.

* * * * *

UNITED STATES PATENT AND TRADEMARK OFFICE

CERTIFICATE OF CORRECTION

PATENT NO. : 4,928,388

DATED : May 29, 1990

INVENTOR(S) : Ernest A. Dacey, Jr.

It is certified that error appears in the above-identified patent and that said Letters Patent is hereby corrected as shown below:

Column 5, line 35, delete "1" and insert ---- I ----.

Column 7, line 57, delete "72" and insert ---- 70 ----.

Column 9, line 47, after "96" insert a period ---- . ----.

Column 10, line 59, delete "4B" and insert ---- 48 ----.

Column 11, line 43, delete "small".

Signed and Sealed this

Eighteenth Day of June, 1991

*Attest:*

*Attesting Officer*

HARRY F. MANBECK, JR.

*Commissioner of Patents and Trademarks*